United States Patent [19]

Hashimoto

[11] Patent Number: 4,532,680

[45] Date of Patent: Aug. 6, 1985

[54] DOUBLE CLIP FOR OFFICE USE

[75] Inventor: Seiichi Hashimoto, Higashi-Osaka, Japan

[73] Assignee: Kabushiki Kaisha Taiyo Hatsujyo Seisakusho, Osaka, Japan

[21] Appl. No.: 515,569

[22] Filed: Jul. 20, 1983

[30] Foreign Application Priority Data

Aug. 6, 1982 [JP] Japan ..... 57-119596[U]

[51] Int. Cl.[3] ..... B42F 1/02

[52] U.S. Cl. ..... 24/67 R; 24/67.3; 24/67.5; 24/67.9

[58] Field of Search ..... 24/499, 500, 503, 504, 24/505, 506, 501, 502, 67 R, 67.5, 67.9, 67.3, 180, 186

[56] References Cited

U.S. PATENT DOCUMENTS

| | | | |
|---|---|---|---|
| 629,212 | 7/1899 | Schryver | 24/503 |
| 1,857,934 | 5/1932 | Blackburn | 24/67.5 |
| 2,704,216 | 3/1955 | Slonneger | 24/67.5 |
| 3,286,381 | 11/1966 | Wooge | 24/67.5 |
| 3,290,751 | 12/1966 | Besnier | 24/67.9 |
| 3,823,443 | 7/1974 | Takabayashi | 24/186 |
| 3,893,813 | 7/1975 | Johnson | 24/186 |
| 4,332,060 | 6/1982 | Sato | 24/67.9 |

FOREIGN PATENT DOCUMENTS

| | | | |
|---|---|---|---|
| 868055 | 12/1941 | France | 24/67.5 |
| 880482 | 10/1961 | United Kingdom | 24/67.5 |
| 1269858 | 4/1972 | United Kingdom | 24/186 |

*Primary Examiner*—Victor N. Sakran

*Attorney, Agent, or Firm*—Armstrong, Nikaido, Marmelstein & Kubovcik

[57] ABSTRACT

The present invention relates to a double clip for office use comprising a clip main body of metal spring sheet bent into an isosceles triangular cross-section, and operating levers of metal wire tiltably and pivotally connected to the clip main body so as to open the apex against the spring force, wherein index caps of synthetic resin serving as knobs are removably fitted on the bent front ends of the levers, thereby providing the double clip itself with an index indicating function in connection with filing and subsequent withdrawal of documents to facilitate the handling of documents while using the index caps as knobs to open and close the clip main body without giving pain to the finger tips of the user.

3 Claims, 6 Drawing Figures

DOUBLE CLIP FOR OFFICE USE

BACKGROUND OF THE INVENTION

Generally, a double clip for office use for filing a bundle of documents to keep it in custody comprises a clip main body of metal spring sheet bent into a substantially isosceles triangular cross-section with the base forming the back wall, and operating levers of metal wire tiltably and pivotally connected to the clip main body to open the closed apex against the spring force. A commercially available conventional article of this type has only plating applied to the clip main body thereof, the entire outer surface being covered with a black metal film. Thus, the double clip itself cannot be utilized as an index for distinguishing documents from each other in connection with filing and subsequent withdrawal of documents, and its ornamental effect as a stationery article is monotonous and lacking in attractiveness.

Further, the operative levers are each formed by bending a single metal wire, with their front ends being intended to directly receive the finger tips of the user to open the clip main body against the spring force. Thus, there is another problem that during operation the user feels pain in his finger tips, so that he cannot comfortably and lightly operate the double clip for opening and closing the same.

SUMMARY OF THE INVENTION

The present invention has been accomplished to solve these problems.

Accordingly, a first object of the invention is to provide a double clip for office use wherein index caps of synthetic resin serving as knobs are removably fitted on the bent front ends of operating levers of metal wire used to open the clip main body, thereby providing the double clip itself with an index indicating function from the caps to enable efficient filing and subsequent withdrawal of documents using the caps as knobs to smoothly open and close the clip main body without giving pain to the finger tips of the user. Thus, the caps of synthetic resin has a dual function, namely, an index indicating function for distinguishing documents from each other, and a safety function for said opening and closing operation. Further, mass productivity and the ornamental effect as a stationery article are increased.

A second object is to provide a double clip for office use wherein each index cap is built up of two plates, front and back, pivotally connected together so that they can be opened and closed, said plates being adapted to clamp the bent front end of the lever through their recess-and-projection engagement to prevent the caps from slipping off, thus enabline the fitting operation on the caps in a so-called at-a-touch fashion and yet providing a reliable fixed state free from positional shift and slip-off. Thus, the directionality of the recess-and-projection engagement is determined to coincide with the operative directionality of the opening and closing action, to thereby maintain the unyielding fixed state.

Other objects of the invention will become apparent from the following description of embodiments of the invention.

DESCRIPTION OF THE PREFERRED EMBODIMENTS

Figure 1:
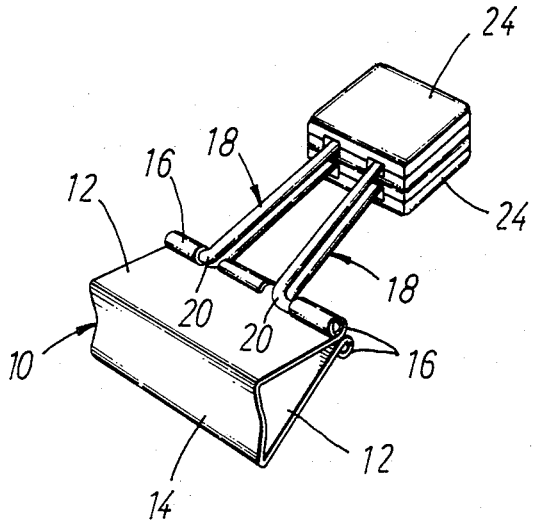
FIG. 1 is a perspective view of a double clip for office use according to the present invention.
Figure 2:
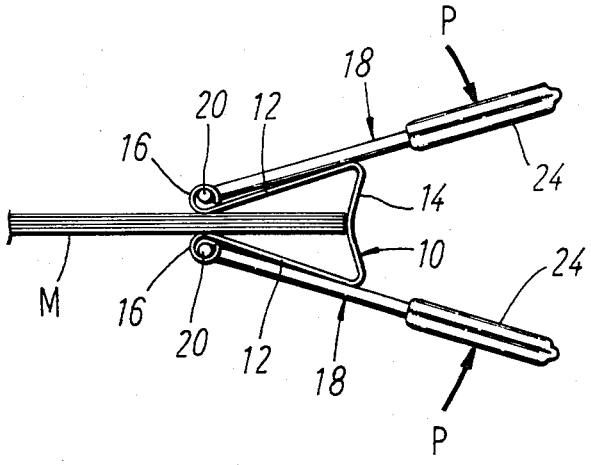
FIG. 2 is a side view showing an opening operation on the double clip.

The arrangement of the present invention will now be described in detail with reference to the drawigs. In FIGS. 1 and 2 showing a double clip for office use in its entirety, the numeral 10 denotes a clip main body formed of spring steel sheet bent into an isosceles triangular cross-section comprising a pair of opposed clipping walls 12 adapted to hold a bundle of documents M therebetween, and a back wall 14 continuously and integrally bridging said clipping walls, said back wall 14 forming the base of the triangle, the opposed free ends, which form the apex, being normally closed. The numeral 16 denotes lever receiving cylinders positioned at the free ends and each being continuously outwardly curled from the associated clipping wall 12, there being a total of four such cylinders forming pairs, each pair being positioned on the opposite ends of the associated clipping wall to extend along the width thereof, but it is possible to employ an arrangement wherein a total of two such cylinders are provided, each positioned at the middle of the associated clipping wall.

The numeral 18 denotes a pair of operating levers for opening and closing the clip main body 10, each being formed of a single round steel wire (e.g., piano wire) bent into a generally elongated U-shape, each operating lever having a pair of attaching shafts 20 formed thereon by bending its base ends at right angles so that thet can be removably inserted from inside into the receiving cylinders 16 of the clipping main body 10 to allow the oprating lever to be tilted around the pivot axis. In this case, the notched edges of the receiving cylinders 16 are of special shape whereby the distance of each lever 18 due to the bending of the lever is narrowed against the spring force in the middle stage of the tilting movement but in the final stages of rising and prostration the levers 18 remain in their positions unless they are subjected to a manual operating force. In addition, though not shown, it is also possible to bend the aforesaid attaching shafts 20 inwardly at right angles so that they are inserted from outside into the receiving cylinders 16 against the spring force.

The numeral 22 denotes knobs generally arcuately and continuously bent at the front ends of the levers 18. Thus, firmly nipping the knobs 22 of the pair of levers 18 by the user's finger tips results in the free ends of the clip main body 10 being forcibly opened through lever action against the spring force. According to the present invention, index caps 24 of synthetic resin are fitted on the knobs 22 to directly receive the finger tips for opening and closing operation.

Figure 3:
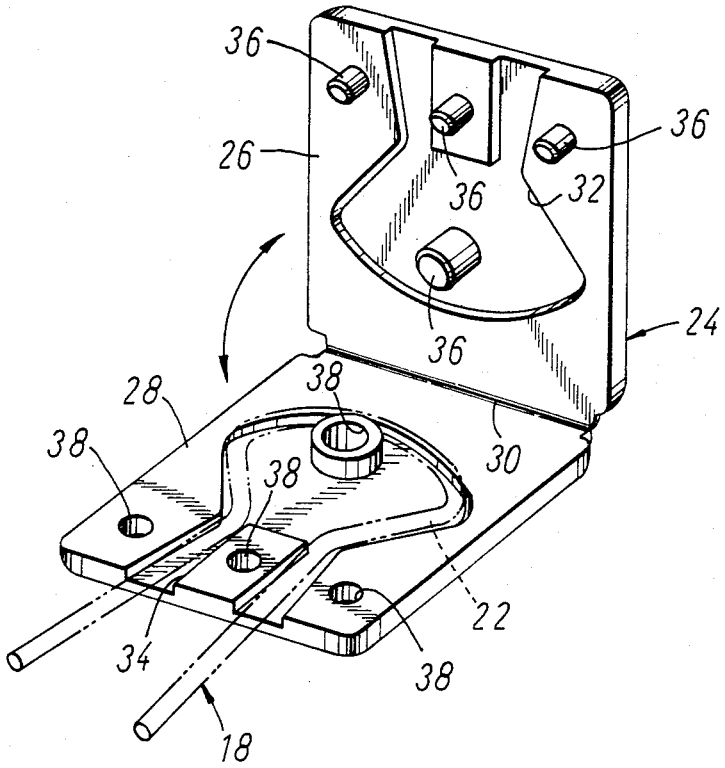
FIG. 3 is an enlarged perspective view of an index can.
Figure 4:
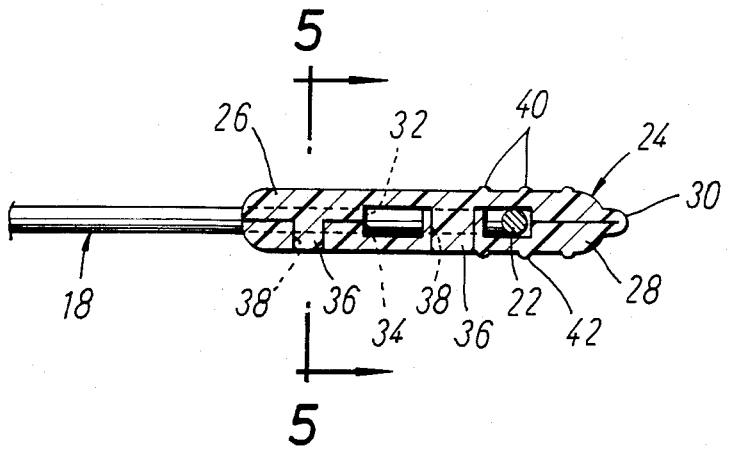
FIG. 4 is a central sectional view showing the mounted state of the cap on an enlarged scale.
Figure 5:
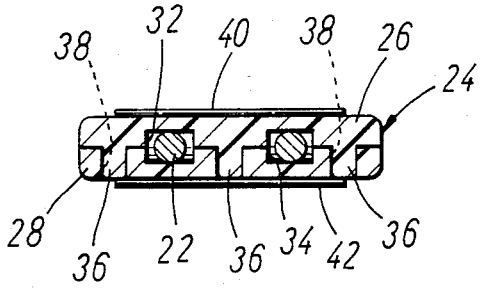
FIG. 5 is a front sectional view taken along the line 5—5 of FIG. 4.

In FIGS. 3–5 showing the index cap 24, the numeral 26 and 28 denote identical, substantially square front and back plates pivotally connected together by a thin-walled hinge 30 so that they can be opened and closed. The numerals 32 and 34 denote wire receiving grooves correspondingly formed in the opposed inner surfaces of the plates 26 and 28, said grooves being in substantially arcuate form matching the knobs 22 at the bent front ends of the levers 18, and defining low steps as a whole. However, the grooves 32 and 34 are not limited to being equal in depth; for example, one of the plates 26 and 28 may be formed with a deep groove, while leaving the other ungrooved. Besides being square, the plates 26 and 28 may be circular, for example.

The numeral 36 denotes a plurality of projections formed on the inner surface of the front plate 26, and 38 denotes a plurality of holes formed in the inner surface of the back plate 28 associated with said projections so that the latter are inserted into said holes to thereby maintain the front and back plates 26 and 28 in their closed state to clamp the knob 22 of the front end of the lever 18 received therein. In this case, since large and small projections 36 are passed through the middle region of the aforesaid arcuately bent knob 22, there is no possibility of the index cap 24 shifting from the lever 18 or slipping off. While the holes for receiving the projections 36 are shown as throughgoing holes, they may be blind holes, the only requirement being to provide cancelable recess-and-projection engagement. The numerals 40 and 42 denote slippagepreventive projections formed on the outer surfaces of the plates 26 and 28.

As described above, the index cap can be easily fitted on the knob 22 of the front end of the lever 18 in a so-called at-a-touch fashion by holding the front and back plates 26 and 28 with finger tips and closing them with the knob held therebetween, and since the directionality which strengthens the engagement between the projections 36 and the holes 38 coincides with the directionality of operating forces applied to the levers 18 to open and close the clip main body 10 (see arrows P in FIG. 2), there is no possibility of the fixed state being weakened or the caps 24 slipping off. Thus, while the mounting operation is easy and simple, it is possible to maintain the durable fixed state of the caps. With finger tips applied to the caps 24 serving as knobs, which allow comfortable operation on the levers 18, the clip main body 10 can be smoothly opened and closed. It is clear that by canceling the engagement between the projections 36 and the holes 38 of the front and back plates 26 and 28, the caps 24 can be easily dismounted from the knobs 22 and such caps 24 can be exchanged for other caps.

Figure 6:
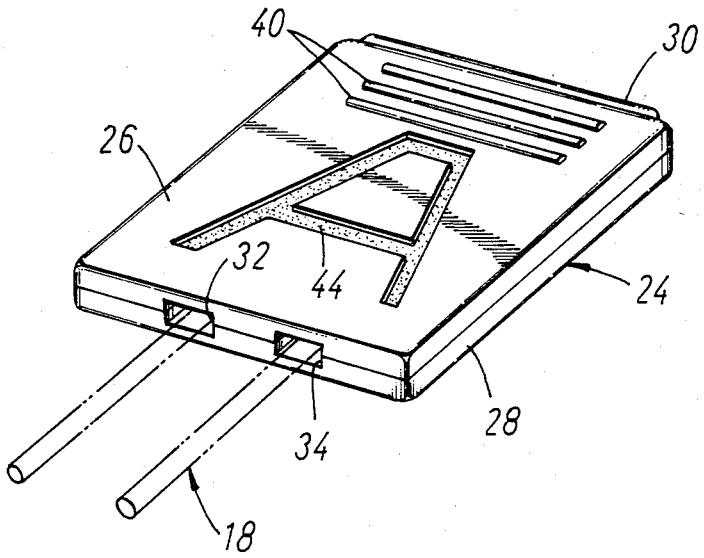
FIG. 6 is an enlarged perspective view of a modification of the index cap.

It is preferable to apply color to the index caps 24 or, as illustrated in FIG. 6, to apply a letter, sign or other mark 44. That is, color synthetic resin is employed or the mark 44 is applied at the same time as the front and back plates 26 and 28 are molded. With this arrangement, the indexing function of the caps 24 can be improved and moreover, a graceful ornamental effect can be imparted to the double clip itself as a stationery article, enabling office work to be done more pleasantly and rationally. In this connection, in FIG. 6, the letter "A" in the alphabet, as the mark 44, is engraved on the plate below the surface, but the mark is not limited thereto.

At any rate, in the double clip for office use according to the present invention, the synthetic resin caps 24 having both a knob function and an index indicating function are removably fitted on the bent front knobs 22 of the operating levers 18 in such a manner as to clamp the knobs, so that the intended object can be achieved in a very simple arrangement. Further, the caps 24 can be mass-produced and the operation of mounting them on the levers 18 can be performed efficiently. Thus, the invention is very useful.

What is claimed is:

1. A double clip for office use comprising a clip main body of metal spring sheet bent into an isosceles triangular cross-section with the base of the triangle forming the back wall of the clip main body, and operating levers of metal wire tiltably and pivotally connected to the clip main body to open the apex of the clip main body against the spring force, wherein a pair of index caps of flexible synthetic resin serving as knobs are removably fitted on the loops at the front end of each lever in such a manner as to resiliently clamp to said end, whereby said index caps provide indicia for indexing.

2. A double clip for office use comprising a clip main body of metal spring sheet bent into an isosceles triangular cross-section with the base of the triangle forming the back wall of the clip and operating levers of metal wire tiltably and pivotally connected to the clip main body to open the apex against the spring force, wherein index caps of flexible synthetic resin serving as knobs are removably fitted on the loops at the front end of each lever in such a manner as to resiliently clamp to said end, whereby said index caps provide indicia for indexing, and wherein each index cap is built up of front and back plates pivotally connected together so that they can be opened and closed, said plates being adapted to clamp to the loops at the front ends of the levers by having projections fron one plate engaging recesses of the other plate to retain the plates in engagement with said loops.

3. A double clip for office use as set forth in claim 1, wherein the index caps are integrally given indicia for indexing.

* * * * *